US008707498B2

(12) United States Patent
Crawford et al.

(10) Patent No.: US 8,707,498 B2
(45) Date of Patent: Apr. 29, 2014

(54) MULTIFUNCTIONAL CLEANING TOOL

(75) Inventors: James B. Crawford, Lafayette, LA (US); Joseph W. Elsbury, Broussard, LA (US); James R. Crawford, Lafayette, LA (US)

(73) Assignee: Amcol International Corp., Hoffman Estates, IL (US)

( * ) Notice: Subject to any disclaimer, the term of this patent is extended or adjusted under 35 U.S.C. 154(b) by 497 days.

(21) Appl. No.: 12/925,637

(22) Filed: Oct. 26, 2010

(65) Prior Publication Data

US 2012/0097192 A1 Apr. 26, 2012

(51) Int. Cl.
*B08B 9/093* (2006.01)

(52) U.S. Cl.
USPC ..... 15/104.05; 134/166 R; 134/167 C

(58) Field of Classification Search
USPC ..... 15/104.05, 104.06, 104.09, 104.31, 15/104.12; 134/94.1, 95.3, 103.2, 103.3, 134/166 R, 168 R, 167 C, 168 C, 198
See application file for complete search history.

(56) References Cited

U.S. PATENT DOCUMENTS

| | | | | |
|---|---|---|---|---|
| 3,835,889 | A * | 9/1974 | Hyde | 138/93 |
| 5,565,633 | A | 10/1996 | Wernicke | |
| 5,732,774 | A | 3/1998 | Haggard | |
| 5,795,402 | A * | 8/1998 | Hargett et al. | 134/8 |
| 6,098,642 | A * | 8/2000 | Crane | 134/167 C |
| 6,368,418 | B1 * | 4/2002 | Rowe | 134/8 |
| 6,374,838 | B1 * | 4/2002 | Baugh | 134/167 C |
| 6,475,294 | B2 | 11/2002 | McCanna et al. | |
| 6,561,280 | B1 | 5/2003 | Baugh et al. | |
| 6,651,744 | B1 * | 11/2003 | Crawford | 166/311 |
| 7,025,142 | B2 * | 4/2006 | Crawford | 166/311 |
| 7,178,588 | B2 | 2/2007 | Harper et al. | |
| 7,836,947 | B2 * | 11/2010 | Booth | 166/175 |
| 8,298,349 | B2 * | 10/2012 | Wojciechowski et al. | 134/167 C |
| 2003/0140946 | A1 | 7/2003 | Coats | |
| 2004/0007355 | A1 | 1/2004 | Hern et al. | |
| 2004/0074632 | A1 * | 4/2004 | Shiraishi et al. | 165/76 |
| 2004/0118565 | A1 * | 6/2004 | Crawford | 166/312 |
| 2004/0194809 | A1 * | 10/2004 | Crawford et al. | 134/22.12 |
| 2004/0247451 | A1 | 12/2004 | Durward | |
| 2005/0283927 | A1 | 12/2005 | Kinnari et al. | |
| 2007/0165487 | A1 | 7/2007 | Nutt et al. | |
| 2009/0199873 | A1 * | 8/2009 | Pruett | 134/22.12 |
| 2009/0260695 | A1 | 10/2009 | France et al. | |
| 2010/0044053 | A1 | 2/2010 | Grimseth et al. | |
| 2012/0048312 | A1 * | 3/2012 | Wilson et al. | 134/166 |

OTHER PUBLICATIONS

Davidson; "An Introduction to Pipeline Pigging;" Halliburton Pipeline and Process Services—Pigging Products and Services Association; 12 pages; Copyright 2002.

(Continued)

*Primary Examiner* — Laura C Guidotti
*Assistant Examiner* — Michael Jennings
(74) *Attorney, Agent, or Firm* — Marshall, Gerstein & Borun LLP

(57) ABSTRACT

A method of cleaning a tubular with a cleaning tool that includes the steps of disposing the cleaning tool in the tubular, the cleaning tool having a main body with a first end, a second end, an inlet, an outlet, and a propulsion relief assembly disposed proximate to the second end. The method further includes the steps of sufficiently pressurizing fluid behind the tubular to propel the cleaning tool along the tubular, and increasing the pressure of the fluid to actuate the propulsion relief assembly, whereby fluid is jetted out the outlet and out of the propulsion relief assembly.

10 Claims, 12 Drawing Sheets

(56) References Cited

OTHER PUBLICATIONS

Verleun; "Cleaning of Oil & Gas Pipelines On-Line & Off-Line—N-Spec® an activity of Brenntag;" 5 pages; Pigging Products and Services Association; Copyright 2003.

Russel et al.; "Development of a Pig Based Inspection Tool Utilising Maps Stress Measurement Technology;" 10 pages; Pigging Products and Services Association; Copyright 2007.

Stanley; "A Contraflow Tetherless Mechanical Pipeline Crawler;" RST Projects Ltd, a Weatherford Company—Pigging Products and Services Association; 9 pages; Copyright 2003.

"Pigging: Increasing Appreciation of an Industry Truly Come of Age;" Pipeline and Gas Journal; Aug. 2002; 4 pages.

Fretwell; "Developments in Mechanical Production Cleaning of Pipelines;" Pipeline Engineering—Pigging Products and Services Association; 10 pages; Copyright 2007.

Stoltze; "A New Pipeline Cleaning Technology: Hydraulically Activated Power Pigging (HAPP™);" 6 pages; Pigging Products and Services Association; Copyright 2007.

Nicholson; "Smart Utility Pig Technology in Pipeline Operations;" Weatherford Pipeline & Specialty Services—Pigging Products and Services Association; 12 pages; Copyright 2004.

PCT International Search Report for Patent Application No. PCT/US2011/001812, dated Mar. 8, 2012 (14 pages).

* cited by examiner

MULTIFUNCTIONAL CLEANING TOOL

BACKGROUND OF DISCLOSURE

1. Field of the Disclosure

Embodiments disclosed herein generally relate to tools, systems, and methods for the removal of obstructions, deposits and/or other debris in tubulars, wellbores, and other confined areas. Specific embodiments relate to a multifunctional cleaning tool for the cleaning of pipelines, especially long-extended and/or horizontal pipelines, and methods for using the same.

2. Background Art

A characteristic common to hydrocarbon production operations throughout the world is the eventual build-up of a wax or paraffin component of the hydrocarbons that deposits on the walls of a pipeline, and solidifies at low temperatures. Some of these waxes or paraffins deposit and/or solidify at temperatures in excess of 100 degrees Fahrenheit, which means the deposits will form on pipeline surfaces even at temperatures close to ambient. Once deposits form, the thickness of the deposit layer will increase over time, which causes, for example, increased pressure drop and/or decrease in desired flow rate in the pipeline.

A common example of where this situation is a frequent occurrence is in subsea production operations. In this instance, pipelines are used to connect subsea wellheads to one another and/or to surface facilities so that hydrocarbons may be produced and recovered from the subsea wells and transported therebetween. Additionally, longer pipelines are routinely used to transfer production fluids from offshore installations to shore. As relatively hot hydrocarbons are produced from subterranean formations up to the sea floor, and subsequently through pipelines extending along the sea floor, the relatively low temperature of the surrounding water cools the hydrocarbons. This cooling rapidly causes the wax, paraffin, etc. present in the hydrocarbons to deposit and enter the solid phase.

It is not uncommon for pipelines to have more than 90% of the flow area blocked with the built up layer of deposits. As a consequence, production operators see operation costs significantly increase over-budget. For example, pump capacities need to be increased to compensate negative effects, such as restricted flow due to reduced inner diameters of pipelines, increased wall roughness, and increased viscosity of the oil. In general, blockages in production or transfer lines are extremely costly because they reduce, hinder, and may even stop production.

As a result, strategies and techniques have been developed to limit deposit formation, as well as to clean affected pipelines (e.g., flow assurance). Most often, a deposit control strategy consists of removing the deposits from the wall of the pipeline. One well known method of treating deposit buildup in pipelines, as shown in FIGS. 1A and 1B together, is to insert a mechanical cleaning device called a "pig" into the flow stream and let the pig remove some of the deposits 199. A pig tool 100 typically entails a cylindrical or spherical body or housing 105 connected with cups 110 or other devices that will seal, brush, scrape, etc. against the internal diameter 133 of the pipeline 131, such that at least some of the deposits are mechanically removed as the pig 100 runs through the pipeline.

In a large number of cases regular pigging manages to keep the deposit formation within tolerable limits. As such, a regular pipeline maintenance program with pigs is normally prescribed as a preventative measure to reduce pipeline blockage, and is becoming more and more common today. However, the use of the conventional pig 100 is not without limitations.

One problem with using conventional pigs is that deposits 199, such as waxes and paraffins, are relatively soft and contain large quantities of oil. To some extent, the conventional pigs actually compress the deposits against the wall and squeeze the oil out, leaving a harder and stronger layer of deposits remaining.

A second problem is that when the layer of deposits 199 on the internal surface 133 of the pipe 131 is too thick, sloughing or shedding of the deposits may occur. For example, if the deposits 199 start to separate from the wall and continue to do so, the conventional pig 100 begins to literally form a block of deposit mass ahead of its end 109. This action drives more and more deposits off the wall 133 of the pipeline 131 until the pressure within the pipeline will no longer be able to move the pig 100 and the block of mass any further.

At that time the pipeline 133 is fully blocked, and the pig 100 cannot be moved by pressure from either end. An operator cannot increase pressure to move the pig from the rear because conventional pigs are not designed to withstand the extreme pressures, and the pig will blow apart. And an operator cannot increase pressure to move the pig from the front because the block of mass blocks flow.

In recent years, oil and gas operators have discovered a technique to aid pig deployment that includes the use a continuous length of flexible tubing with the pig attached at the distal end thereof. This tubing, which may be, for example, "coiled tubing," utilizes a continuous length of up to 10,000 feet of flexible tubing stored on a reel. The continuous tubing is relatively flexible, and is typically rolled off a large reel (from a boat or other support structure) and into pipeline. Such conventional coiled tubing can be translated in and out of a wellbore or other vertical structure in a continuous manner. As such, the continuous tubing can be inserted into a pipeline and used to push or otherwise urge a pig through the line in instances where the required pressure would otherwise be too large for the pig too handle.

Be that as it may, large forces are often required to insert and withdraw extended lengths of continuous tubing into a pipeline that may be filled with hydrocarbons, solid deposits, and/or other materials. Moreover, coiled tubing operations are unusable for horizontal flow lines (e.g., transfer lines, etc.) of any significant length. When used in long horizontal lines, the continuous tubing becomes too horizontal, and as such the weight of the tubing acts against the internal surfaces of the pipeline, thereby creating frictional forces that impede the advancement of the tubing through the pipeline. The weight of the tubing may cause the tubing to rest on the inside of the pipeline, creating a resistance to moving the tubing relative to the pipeline, as well as damage to the wall of the pipeline and the tubing.

As a result, tubing conveyed systems may not be preferred in pipelines having long horizontal lengths because the weight of the tubing may hinder the travel of the pig and/or cause damage. Moreover, use of rigid tubing may be problematic in that the tubing may not be flexible enough to be inserted into pipelines that have bends or other tortuous pathways.

As such, it is not possible to effectively use conventional pig technology in long horizontal pipelines. The required pressure to run the pig completely through the pipeline becomes too great, such that the pig will blow apart, be destroyed, and/or rendered unusable. The cost to deploy tools with continuous tubing is very expensive, and the use of continuous tubing to aid in urging pigs horizontally is of no help because of the aforementioned problems and limitations.

Thus, there remains a need for a tool, system, and method for cleaning undesirable materials built-up, or otherwise collected, on the inside surface of pipelines. There is tremendous need for a tool and method for cleaning long-extended and/or horizontal pipelines, including lengths in excess of 10 miles, as well as a tool that may be deployed without continuous tubing. There is a great need for a tool that can withstand extreme pressures in order to run tether-free in pipelines when desired, and also have internal protection systems to prevent over pressurization of the tool.

There is a need for a multifunctional cleaning tool that may perform mechanical cleaning, as well as pressurized cleaning. There is also a need for a multifunctional tool that may perform downhole operations in addition to cleaning. As such, the current needs of the pipeline industry further require a tool that is multifunctional, cost-effective, and easy to manufacture and operate.

SUMMARY OF DISCLOSURE

Embodiments disclosed herein may provide a multifunctional cleaning tool for cleaning tubulars, whereby the cleaning tool may include a main body having a first end and a second end, an inlet proximate to the first end, and an outlet disposed in the second end. There may be a propulsion relief assembly proximate to the second end. The cleaning tool may be configured for a first fluid pressure to move the tool through the tubular, provide flow out of the outlet, and also provide an internal propulsion force to the cleaning tool without actuating the propulsion relief assembly. In addition, the cleaning tool may be further configured for a second fluid pressure to also provide flow out of the outlet and also actuate the propulsion relief assembly.

Other embodiments of the disclosure provide a multifunctional cleaning tool for cleaning tubulars that may include a main body having a first end and a second end, and a propulsion relief assembly proximate to the second end. There may be at least one fluid passage disposed in the main body that has an inlet and an outlet, as well as a bypass mechanism. The cleaning tool may be configured for a first fluid pressure to actuate the propulsion relief assembly, and may also be configured for a second fluid pressure to actuate the bypass mechanism.

Additional embodiments disclosed herein provide for methods of cleaning a tubular with a cleaning tool that may include the steps of disposing the cleaning tool in the tubular, with the cleaning tool having a main body with a first end, a second end, an inlet, an outlet, and a propulsion relief assembly disposed proximate to the second end. The method may further include the steps of sufficiently pressurizing fluid behind the tubular to propel the cleaning tool along the tubular, and increasing the pressure of the fluid to actuate the propulsion relief assembly, whereby fluid is jetted out the outlet and out of the propulsion relief assembly.

Further embodiments disclosed herein describe a multifunctional cleaning tool for cleaning tubulars that may include a main body with a first end and a second end, and at least one fluid passage disposed in the main body, the fluid passage associated with an inlet and an outlet. There may be a propulsion relief assembly proximate to the second end. The cleaning tool may be configured for a first fluid pressure to provide flow out of the outlet and also provide an internal propulsion force to the cleaning tool without actuating the propulsion relief assembly, and the cleaning tool may also be configured for a second fluid pressure to also provide flow out of the outlet and also actuate the propulsion relief assembly.

Other aspects and advantages of the disclosure will be apparent from the following description and the appended claims.

DETAILED DESCRIPTION

Figure 1A:
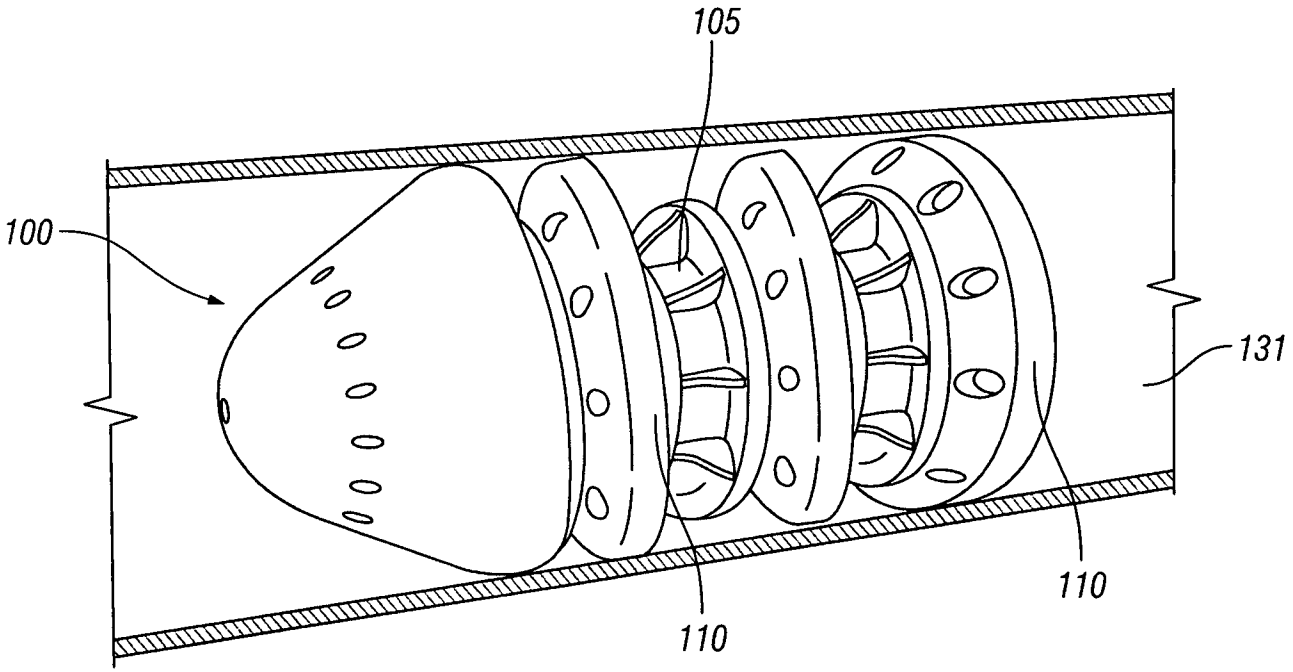
FIG. 1A shows a conventional pig deployed into a pipeline.
Figure 1B:
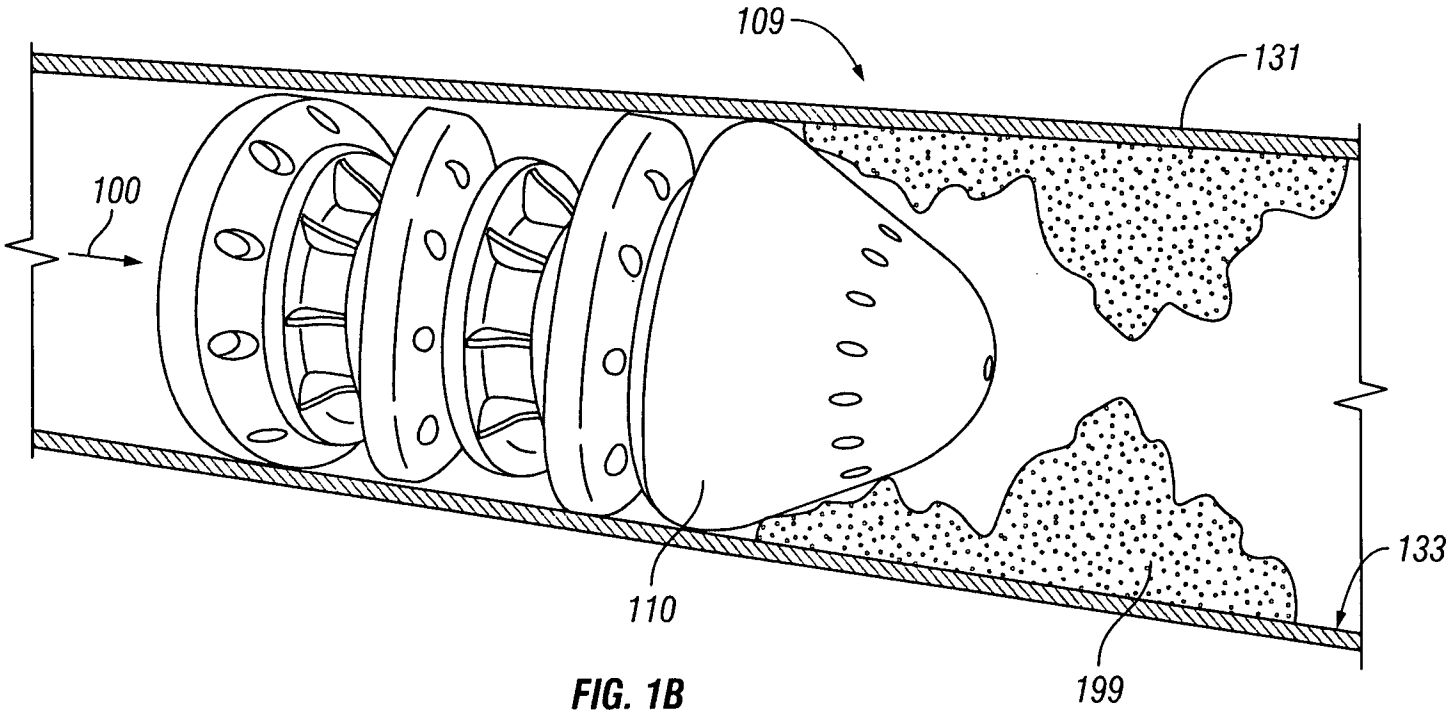
FIG. 1B shows the conventional pig of 1A deployed in a pipeline in a stuck position.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," "front," "back," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the surface along the wellbore (i.e., into the wellbore), but is meant for illustrative purposes only, and the terms are not meant to limit the disclosure.

Figure 2A:
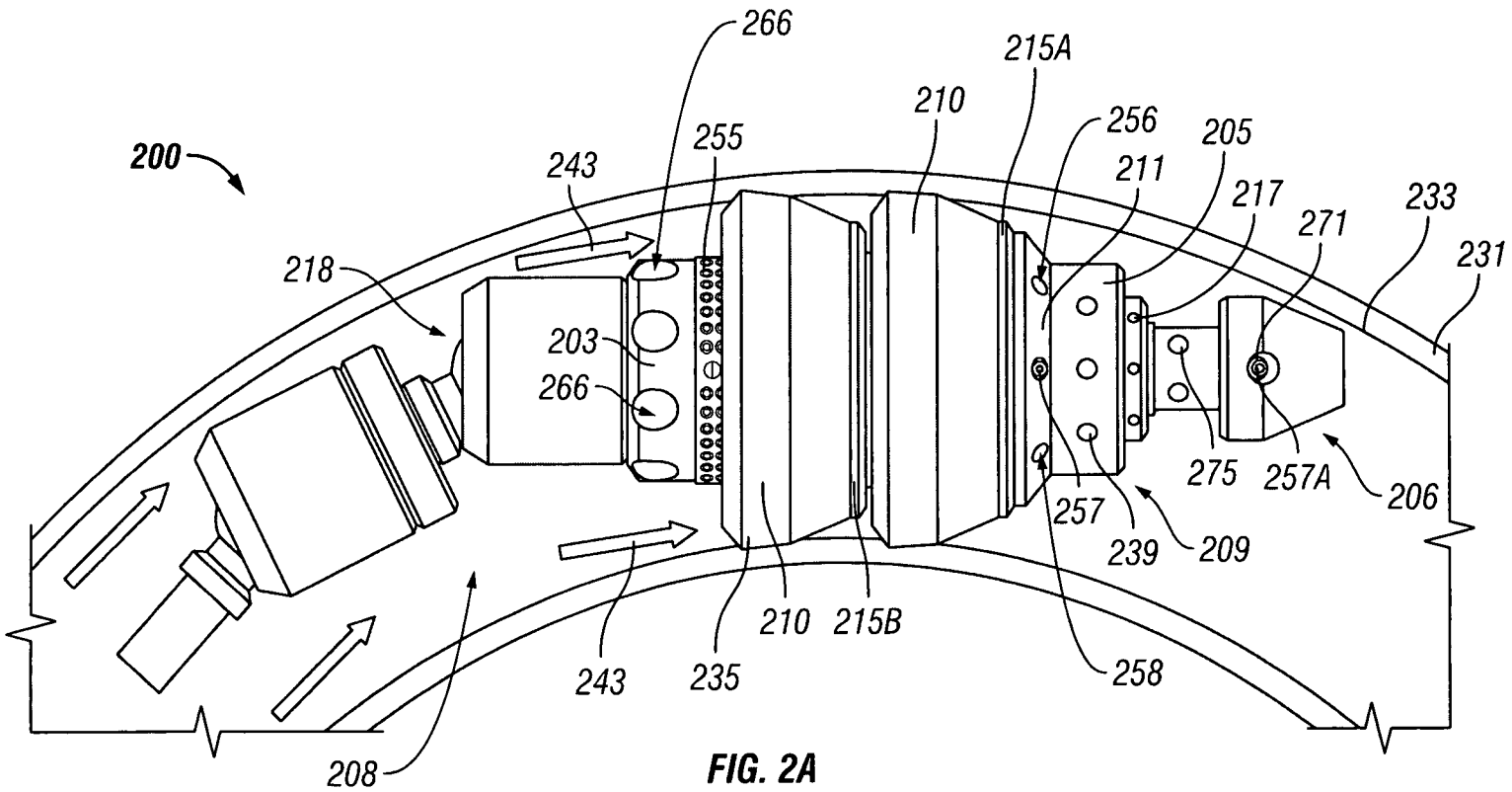
FIG. 2A shows a downhole view of a multifunctional cleaning tool, in accordance with embodiments of the present disclosure.
Figure 2B:
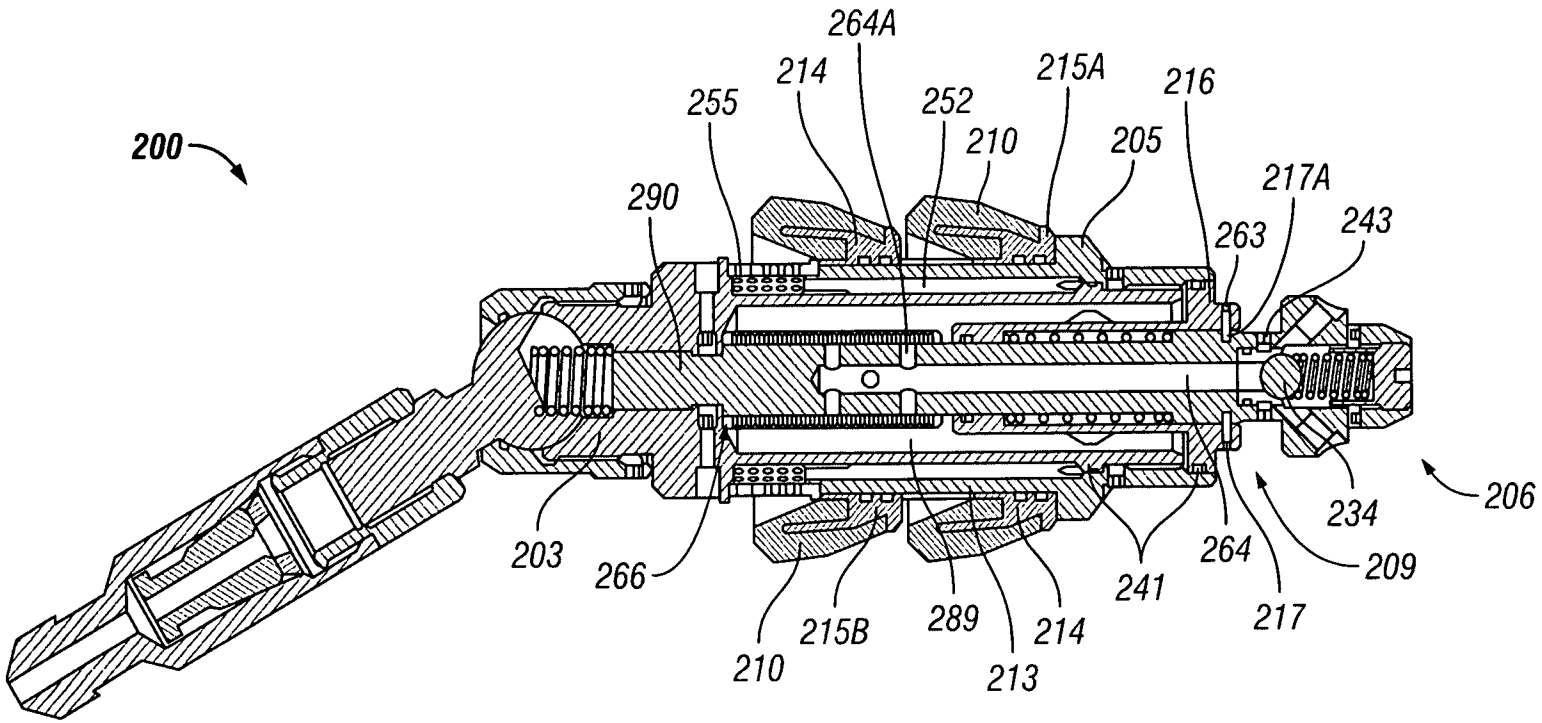
FIG. 2B shows a cross-sectional view of the multifunctional cleaning tool of FIG. 2A, in accordance with embodiments of the present disclosure.

Referring now to FIGS. 2A and 2B, a side perspective view of multifunctional cleaning tool 200 disposed in a pipeline, and a cross-sectional view of the tool, according to embodiments of the present disclosure, are shown. In general, the multifunctional cleaning tool ("tool") 200 may be used for cleaning tubular members, such as pipeline 231, but may also be used for wellbores, transfer lines, etc. However, the type of tubular member and/or cleaning operation is not limited by the embodiments discussed herein. Moreover, the tool 200 is not limited to cleaning a structure that is only "tubular" in shape.

The tool 200 may be a multifunctional device that may include a number of components and subcomponents associated therewith. As shown in FIGS. 2A and 2B together, there may be a tool body 203, which may generally be cylindrical in shape and may be coupled with a housing 205. There may be a number of internal fluid passages associated with body 203 and housing 205. For example, there may be at least one fluid passage 252 formed as a result of the connection between the tool body 203 and the housing 205.

In one embodiment, the fluid passage 252 may be a cavity or other space formed around tool body segment(s) 213. In another embodiment, the fluid passage 252 may be a cavity or other space formed around an inner mandrel 290. The inner mandrel 290 may be securely disposed within the tool body 203, and the mandrel 290 itself may have one or more bores 264 disposed therein. As shown in FIG. 2B, the cavity 289 and the bore 264 may be in fluid communication with each other as a result of one or more channels 264A.

Accordingly, the tool body 203 may include the cavity 289 formed therein, whereby fluid may pass therethrough. As a result of the mandrel 290 disposed within cavity 289, the tool 200 may include the tool body 203 configured with the flow bore 264 that extends at least partially therethrough. As shown, the flow bore 264 may provide fluid communication between the cavity 289 with a part of the tool 200 designated as a propulsion relief assembly (PRA) 206. In an embodiment, the PRA 206 may be, removably connected to the second end 209 of the tool 200.

The PRA 206 may be configured to provide the tool 200 with the ability to have an internal propulsion force. For example, fluid that flows toward tool 200 may enter into cavity 289 via entrance 266, and fluid may flow through channels 264A and into the flow bore 264. Fluid flow within the flow bore 264 may contact an obstruction or restrictor 234 disposed in the PRA 206, and subsequently provide an internal propulsion force thereagainst. Details of the PRA 206 operation and an associated bypass configuration will be provided at a later point in the description.

The tool body 203 and the housing 205 may be secured to each other by a conventional connection as would be known to one of skill in the art, such as, for example, threaded, welded, sealed, etc. In addition, it is noted that any of the connections between any of the components or subcomponents may include one or more securing members inserted and/or fastened between them. For example, pins 239 may be threadably engaged between the housing 205 and the body 203 in order to provide a secured connection therebetween. O-rings, seals, elastomers, or other devices as known in the art, may be used to sealingly engage the body 203 and the housing 205, and other components, with each other, as illustrated by seals 241.

In some embodiments, there may be at least one sealing cup 210 disposed around the housing 205, and in other embodiments, there may be a plurality of sealing cups 210 disposed around housing 205. As shown FIGS. 2A and 2B, there may be two sealing cups 210 disposed proximate to each other, and along the exterior of tool 200. The at least one sealing cup 210 may be constructed of a flexible polymer material, as would be known to one of skill in the art. However, the materials of construction of the cup(s) 210 is not meant to be limited, and may be many different materials, such as flexible hardened rubber, elastomer, etc.

The tool 200 may include a first sleeve 215A sealingly and/or securely engaged to the housing 205, with the seal cup 210 securely connected (i.e., mounted, molded, formed, coupled, etc.) to the first sleeve 215A. As shown, there may also be a second sleeve 215B sealingly engaged to the housing 205, with corresponding seal cup 210 connected to the second sleeve 215B. The seal cups 210 may be configured to sealingly engage the tool 200 to an inner pipeline surface 233, such as at point 235. The seal cups 210 may be oversized in cross-sectional diameter as compared to the inner diameter of pipeline surface 233, such that the seal cups 210 may form a fluid-tight seal when the tool 200 is placed into pipeline 231. In an embodiment, the seal cups 210 may be configured with a cross-sectional diameter that is in the range of about 4% to 8% greater than the inner diameter of pipeline surface 233.

In an embodiment, any of the sleeves (215A, 215B, etc.) may have an internal support member 214 formed integral therewith, and as such any of the sealing cups 210 may include the internal support member 214 that may extend therein. The internal support member 214 may be constructed of metal or other rigid material that may have characteristics known to prevent the sealing cups 210 from flipping, inverting, or blowing apart at high pressures, and/or may be constructed of the same material as the sleeves (215A, 215B). Support members 214 (and the corresponding sleeves) may be, for example, formed from solid blocks of cast iron.

Any of the cups 210 may be fitted with the internal support member 214 that may be configured to bias the cup(s) against the internal surface(s) of the pipeline 231, wellbore, etc. The member 214 may, for example, resemble a wing or arm-shaped protruding member that extends outward from the inner sleeve surface. The use of the support member 214 may provide the cups 210 with longer cup wear, but also provide the ability for the cups to have sufficient compression or collapsibility in order to permit bi-directional service within pipeline 231. As such, the internal support member(s) 214 may also be configured to provide strength, and also bias the sealing cups 210 outward to sealingly engage against internal surface(s) of pipeline 231.

The medium used to propel tool 200, as illustrated by directional arrows 243, may be, for example, an incompressible fluid, such as water, cleaners (e.g., chemicals), hydrocarbonaceous fluids, intermediates, etc., or may just as well be a compressible fluid, such as methane gas. The use of an incompressible fluid may provide an operator with the ability to control the speed of tool 200, as well as overall operation of the tool 200. The choice of the medium and/or the material of the cups 210 should be compatible with each other, as well as with the desired range of operating conditions (e.g., temperature, pressure, etc.).

A movable piston 216 may be coupled between one or more of the subcomponents of tool 200, such as the housing 205, the tool body 203, and the mandrel 290. As shown, there may be one or more shear screws 217 disposed between the piston 216 and the mandrel 290. As shown, the screws 217 may be disposed into tool 200 by way of holes 263. The holes 263 in the piston 216 may be configured to align with corresponding notches 217A in the mandrel 290, such that the screws 217 may be slidably and/or securely inserted therein. In an embodiment, the screws 217 may be configured to break at a pre-determined pressure, whereby a bypass passage (not shown) may be formed through the cavity 289 and out of the second end 209 of the tool 200 if a pre-determined pressure is exceeded.

Referring briefly to FIGS. 5A-5D, various views of an inner mandrel 590 used in a bypass system for a multifunctional cleaning tool according to embodiments of the present disclosure, are shown. As mentioned, the tool (200, FIG. 2B) may include an inner mandrel 590 disposed therein. An end 593 of the mandrel 590 may be connected within the body of the tool (200, FIG. 2B). For example, the end 593 may have threads 593A for threadably connecting with corresponding threads of the body (not shown).

The mandrel 590 may include an elongated section 595 that has a flow bore 564 disposed therein. The flow bore 564 may extend, for example, from the channels 564A, through the elongated section 595, and up to PRA 506. In an embodiment, fluid may enter into the flow bore 564 via the channels 564A, and out of the mandrel 590 via nozzles 571 disposed in the PRA 506. As previously described, there may be a ball seat (232, FIG. 2A) disposed within hollow 594, whereby the ball seat may be securely disposed within the mandrel 590 and/or PRA 506. Securing members (not shown) may be disposed within holes 575A in order to facilitate the secured connection between the ball seat (232, FIG. 2A) and the PRA 506.

There may also be holes 543A disposed in the PRA 506, whereby securing members (243, FIG. 2B) may be disposed therein in order to facilitate the secured connection between an adjustment mechanism (387, FIG. 3A) and the PRA 506. The mandrel 590 may have notches 517A disposed within protruding section 519 and/or elongated member 595. The notches 517A may be configured to receive shear screws (217, FIG. 2A), which may be used to hold a movable piston (216, FIG. 2A) within the tool 200.

Referring now to FIGS. 3A-3D, various views of a multifunctional tool 300 according to embodiments of the present disclosure, are shown. Like the tool 200 previously described, a multifunctional cleaning tool ("tool") 300 may be used to clean tubular members, such as pipelines, wellbores, etc. The tool 300 may include similar components and materials of construction as described for tool 200, such that tool 200 and tool 300 may be similar, however, tool 200 and tool 300 are not necessarily identical.

Figure 3A:
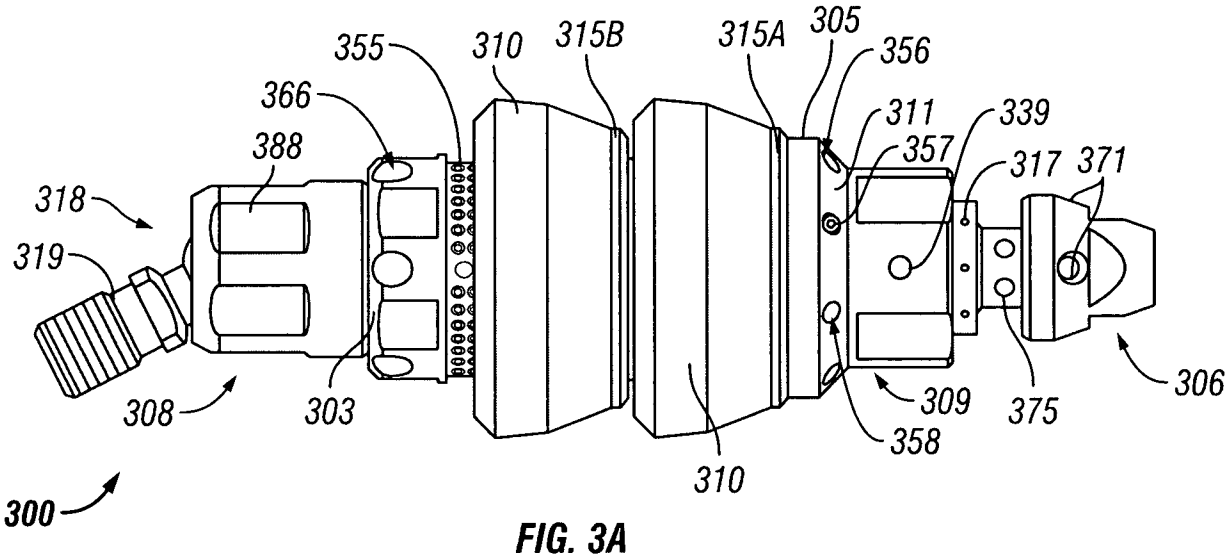
FIGS. 3A and 3B show a side view and a cross sectional view, respectively, of a multifunctional cleaning tool, in accordance with embodiments of the present disclosure.
Figure 3B:
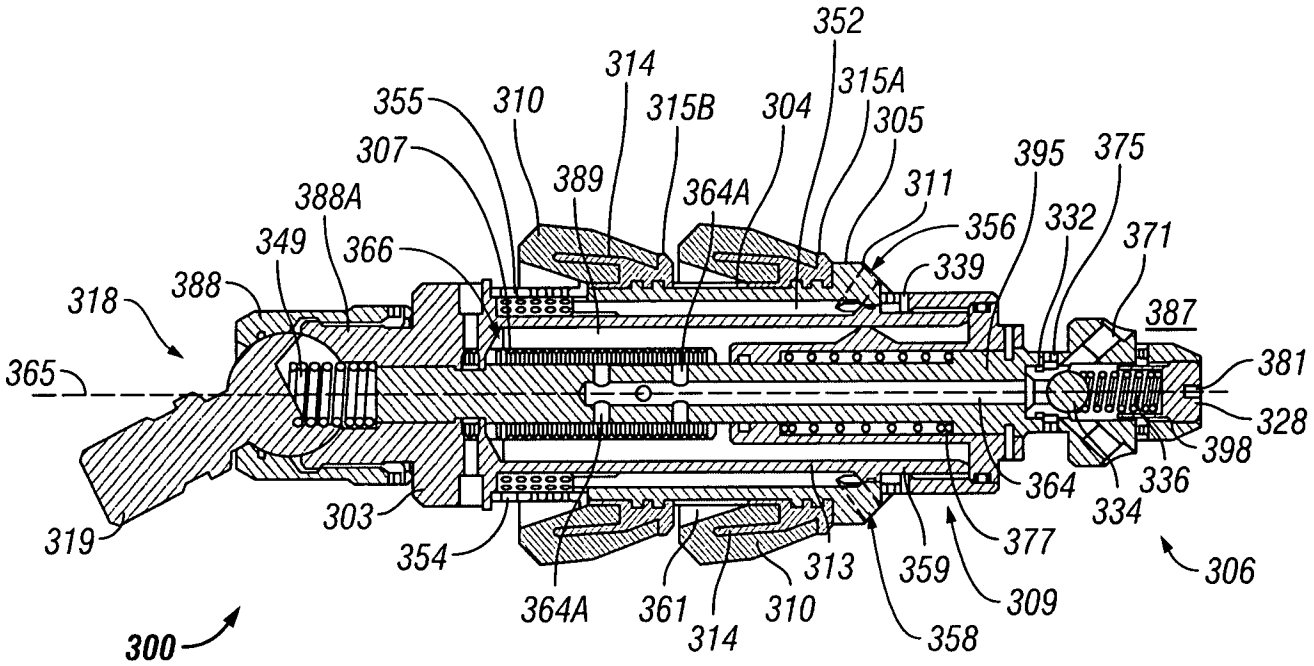
Figure 3C:
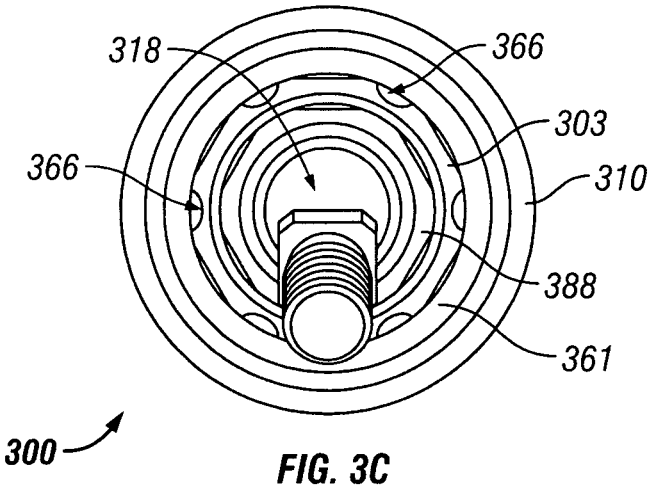
FIGS. 3C and 3D show back and front views, respectively, of the multifunctional cleaning tool of FIGS. 3A and 3B, in accordance with embodiments of the present disclosure.

FIGS. 3A and 3B together illustrate an exterior and cross-sectional view, respectively, of the tool 300. As shown, there may be a tool body 303, as well as a number of internal fluid passages associated with body 303 and/or disposed within tool 300. For example, there may be at least one fluid passage 352 formed between the tool body 303 and a housing 305. As another example, the tool body 303 may include a cavity 389 formed therein, whereby fluid may pass therethrough. There may be an inner mandrel 390 also disposed within the tool body 303, which may itself may have one or more bores 364 disposed therein. As shown in FIG. 3B, the cavity 389 and the bore 364 may be in fluid communication with each other via channels 364A. There may also be a screen 307 disposed around the mandrel 390, such that debris and the like are prevented from entering the flow bore 364.

The tool body 303 and the housing 305 may be secured to each other by a conventional connection as known to one of skill in the art, such as, for example, threaded, welded, sealed, etc. In addition, connections between any of the components or subcomponents of tool 300 may include one or more securing members inserted and/or disposed therebetween. For example, pins 339 may be threadably engaged between the body 303 and the housing 305 in order to provide a secured connection therebetween. O-rings, seals, or other devices as known in the art, may be used to sealingly engage the body 303, the housing 305, as well as other components of the tool 300, with each other.

There may be at least one sealing cup 310 disposed around the housing 305. As shown in FIGS. 3A and 3B, there may be two sealing cups 310 disposed proximate to each other along the exterior of tool 300. The tool 300 may include a first sleeve 315A sealingly engaged to the housing 305, with the seal cup 310 securely connected (i.e., mounted, molded, formed, coupled, etc.) to the first sleeve 315A. As shown, there may also be a second sleeve 315B sealingly engaged to the housing 305, with corresponding seal cup 310 connected to the second sleeve 315B. The sleeve 315A and/or 315B may be connected to the housing 305 in other fashions known in the art, such as threadingly, welded, integral, etc., and the connection of the sleeves is not meant to be limited. In addition, a spacer 304 may be disposed between the sleeves in order to provide adequate distance between the cups 310, as may be desired.

In an embodiment, the seal cups 310 may be configured to sealingly engage the tool 300 to an inner pipeline surface (233, FIG. 2A). As such, the seal cups 310 may be configured with a cross-sectional outer diameter that may be larger than the internal diameter of a pipeline (231, FIG. 2A). In operation, a fluid medium (not shown) that flows from behind the tool 300 may contact the seal cup(s) 310 inside of pockets 361 formed therein at a designated operating pressure, for which the resultant force may push against the seal cup(s) 310, and propel the tool 300 down into the pipeline (231, FIG. 2A), as would be known to one of skill in the art. Any of the sealing cups 310 may include an internal support member 314, like those previously discussed.

Tool 300 may have a first end 308 and a second end 309, and as such, the at least one fluid passage 352 that may partially extend, for example, between an inlet 354 proximate to the first end 308, and a first outlet 356 proximate to the second end 309. The at least one fluid passage 352 may extend through the tool 300 such that the passage 352 may be oriented substantially parallel to a central axis 365 of tool 300.

The inlet 354 may include a filter member or screen 355, and the first outlet 356 may include a nozzle 357. The filter member 355 may be disposed at the inlet 354, while one or more of the nozzles 357 may be disposed at the opposite end of the at least one fluid passage 352. In an embodiment, the nozzles 357 may be disposed at or in the corresponding one or more outlets (354, 356, etc.) of at least one fluid passage 352.

The inlet 354 and the first outlet 356 may be disposed in housing 305. There may also be one or more additional outlets disposed in the housing 305, such as second outlet 358. Like the first outlet 356, the second outlet 358 may also have a nozzle (not shown) disposed therein. As such, any of the outlets 356, 358, etc. disposed in the housing 305 may be configured to jet fluids that flow through the at least one passage 352 out of the tool 300. The jetted fluids may, for example, be used to clean off the walls (e.g., 233, FIG. 2A) of the pipeline (231, FIG. 2A), break up layers of deposits, etc.

Figure 3D:
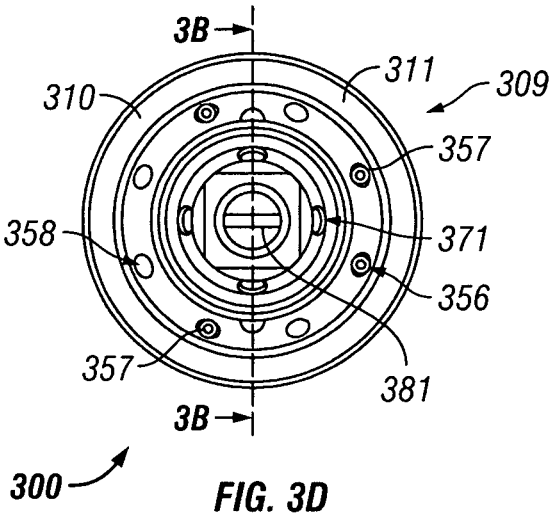

Any of the nozzles 357 of tool 300 may be configured to maintain a pre-set, substantially constant pressure across the tool 300 as fluid is pumped within pipeline (231, FIG. 2A) toward and thru the tool 300. In an embodiment, the outlets and nozzles 357 may be disposed and/or oriented in a substantially circular pattern on surface 311, as shown in FIG. 3D. In other embodiments, one or more of the nozzles 357 may be oriented and/or angled outward (i.e., away from the central axis 365), and generally toward the pipeline surface (233, FIG. 2A). In an exemplary embodiment, one or more of the nozzles 357 may be oriented at an angle between 40 and 50 degrees relative to the central axis 365 of tool 300. The nozzles 357 may each be independently directionally adjustable, and may also each be independently configured (e.g., pre-set) to maintain flow through the nozzles 357 at predetermined rate(s) and/or pressure(s).

There may be additional fluid passages disposed in the tool 300, such as the aforementioned flow bore 364 disposed within inner mandrel 390. In an embodiment, flow bore 364 may fluidly connect cavity 389 with a propulsion relief assembly (PRA) 306. At least part of the PRA 306, such as, for example, a ball seat 332, may be removably connected to the second end 309 of the tool 300, such as by threaded connection and/or with pins 375 securely inserted therein.

The PRA 306 may provide the tool 300 with the ability to have an internal propulsion force thereagainst. For example, fluid that flows toward tool 300 while the tool is disposed in the pipeline (231, FIG. 2A) may enter into the cavity 389 via inlets 366. The path of the fluid may flow through channels 364A and into the flow bore 364, whereby fluid in the flow bore 364 may contact a restrictor 334 or other surface disposed in the PRA 306, and provide an internal propulsion force thereagainst. The restrictor 334 may be, for example, a ball, which may subsequently be positioned in the corresponding ball seat 332 that may be disposed within mandrel 390.

The PRA 306 may be configured to be unaffected by predetermined amounts of pressure, which may be exemplified by a first predetermined pressure or pressure range, and the PRA 306 may have a specific actuation pressure or set-point exemplified by a second predetermined pressure or pressure range. As one example, the first predetermined pressure may be in the range of about 0 to 1000 psi. As another example, the first predetermined pressure may be in the range of about 100 to 10,000 psi. As such, although not limited by the embodiments described and disclosed here, the PRA 306 may be configured, for example, to actuate upon exceeding the set-point determined by an energized adjustment device 387, and thus when the pressure exceeds the first predetermined pressure range.

The device 387 may include an energizer 336 and adjustment mechanism 328 coupled therewith. In an embodiment, the energizer 336 may be compressed to a specific set-point that may be determined by the adjustment of adjustment mechanism 328. As shown in FIG. 3D, mechanism 328 may be securely engageable with an inner hollow 394 of the PRA 306. For example, the mechanism 328 may be threadably engaged with a corresponding surface 398 of the hollow 394.

The mechanism 328 may be adjusted via use of an adjustment tool (not shown) placed into adjustment area 381. In an embodiment, the adjustment tool (not shown) may threadably engage mechanism 328 further into PRA 306, such that mechanism 328 compresses the energizer 336 against the restrictor 334. As such, the restrictor 334 is pressed and/or held in situ against ball seat 332. As would be understood to one of skill in the art, the amount of force required to unseat the restrictor 334 from the ball seat 332 may be proportionally related to the amount of potential energy stored in the compressed energizer 336.

Accordingly, as the pressure of fluid in passage 364 increases, the force on the restrictor 334 increases. At a predetermined point determined by the setting of the adjustment mechanism 328 (which may be proportionally related to the second predetermined pressure(s)), the restrictor 334 will unseat and fluid will be able to flow past the restrictor 334, and out one of more secondary nozzles 371.

As such, the tool 300 may be configured for a first fluid pressure or pressure range to provide jetted fluid flow out of at least outlet 356, and simultaneously may also provide an internal propulsion force to the cleaning tool 300. Accordingly, the tool 300 may also be configured for a second fluid pressure or pressure range (e.g., the second predetermined pressure(s)) to also provide flow out of at least the outlet 356, and also provide flow out of the PRA 306, which may also occur while providing a propulsion force thereto.

The first end 308 may include, for example, and end cap 388 disposed (i.e., positioned, placed, mounted, coupled, connected, fastened, etc.) around an end 388A of the body 303. The end cap 388 and end 388A may be configured for a coupler 318 to be disposed therebetween. The coupler 318 may be configured as a knuckle joint engaged between the end 388 and the end 388A of body 303, but the type of coupler used is not meant to be limited. As such, the coupler 318 may be threadable, quick-disconnect, or other comparable couplers as known in the art. The coupler 318 may be configured for a number of purposes, such as to provide the tool 300 with the ability to be fished. As such, the coupler 318 may be configured with a fishing neck 319.

There may be a bracing member 349 engaged with the coupler 318, which may provide support for the coupler 318, such that the coupler 318 may be biased by the bracing member 349 to align with the axis 365. Biasing the coupler 318 toward the axis 365 may make it easier to connect a fishing tool (not shown) to the fishing neck 319. As illustrated, the bracing member 349 is internal to the tool 300, however, the bracing member 349 may just as well be external to the tool 300, whereby the bracing member 349 may be disposed on or around, at least partially, the fishing neck 319.

In operation, the tool 300 may be advanced within the pipeline (231, FIG. 2A) to a pre-determined distance by pumping fluid into annular space formed between the inner surface (233 of pipeline 231, FIG. 2A) and the tool 300. The fluid may flow through screen 355, into flow passage 352, and one or more nozzles 357. The screen 355 may be configured to prevent debris and/or other materials from entering the flow passage 352 and plugging any of the nozzles 357.

Fluid exiting nozzles 357 may provide a jetting action directed at inner surface (233, FIG. 2A) of pipeline (231, FIG. 2A) that may remove any built-up debris, deposit layers, etc. from the pipeline. Further, such fluid applies pressure across the area of the tool 300 (including cups 310), while providing motive force to propel the tool (and any associated tubing and equipment) within the pipeline as fluid is pumped at predetermined rates and pressures. This motive force, which may be the result of fluid flow in the range of the first or second predetermined pressure range, may also be used to propel the tool 300 further into the pipeline (231, FIG. 2A), even while surface equipment (such as an injector head) may be unable to push continuous tubing into pipeline 231.

There may be times during operation where it may be necessary to bypass or vent large amounts of pressure or fluid thru the tool 300. However, the nozzles 357 and 371 may not be sized to accommodate large flows of fluid in order to relieve pressure. As such, the movable piston 316 may be removably disposed within the tool 300, whereby release of the piston 316 from the tool 300 will provide a bypass configuration.

In order to release the piston 316, the pressure from behind the tool 300 may be increased to a third pre-determined pressure or pressure range, which may be a pressure or pressure range greater than the first or second predetermined pressures and/or pressure ranges. By way of example, this may occur when the tool 300 is being pulled (e.g., retrieved) out of the pipeline (231, FIG. 2A). Because of the fluid tight seal between the tool 300 and the pipeline wall (233, FIG. 2A), as the tool 300 is pulled, the incompressible fluids behind the tool 300 begin building pressure, and eventually require venting in order to relieve the pressure so that the tool 300 may continue to be pulled at manageable pulling forces.

The pressure may continue to build until the predetermined set point of the shear screws 317 is exceeded, at which point the screws 317 may shear and the piston 316 may be movably released such that the pressure may be relieved, and fluids may bypass thru the tool 300 and out of the second end 309.

There may be times when pulling of the tool 300 from the rear is inadequate and/or impossible. Accordingly, pressure may be applied from ahead of the tool 300 to the front end 309. If the bypass system was actuated such that the piston 316 was released, the biased spring 377 may be configured to bias the piston 316 back into the tool 300. In addition, the energizer 336 may bias the restrictor 334 back against the seat 332. As such, pressure may build on the front end 309 of the tool 300, and may be increased sufficiently so that the tool 300 may be urged or assisted out of the pipeline (231, FIG. 2A).

Figure 4:
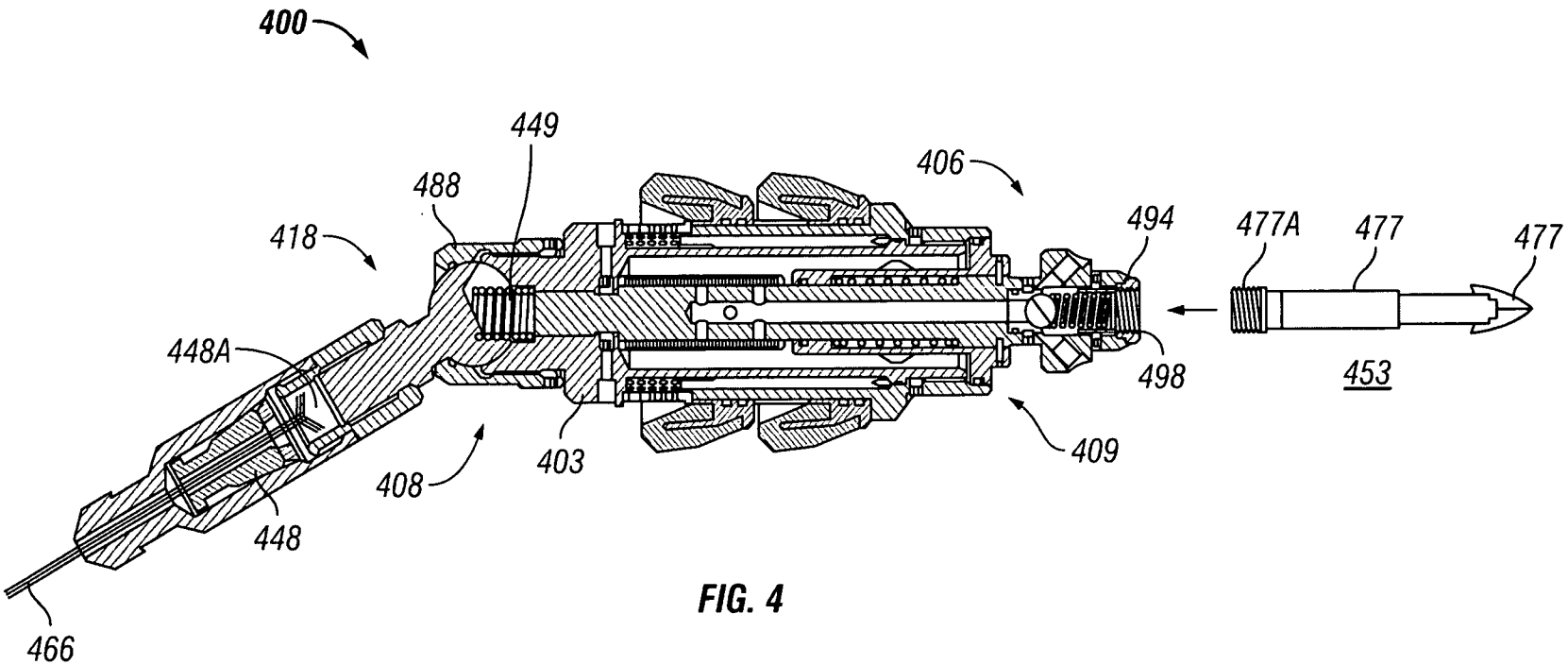
FIG. 4 shows a cross-sectional view of a multifunctional cleaning tool 400 with a coupler 418, in accordance with embodiments of the present disclosure.
Figure 5B:
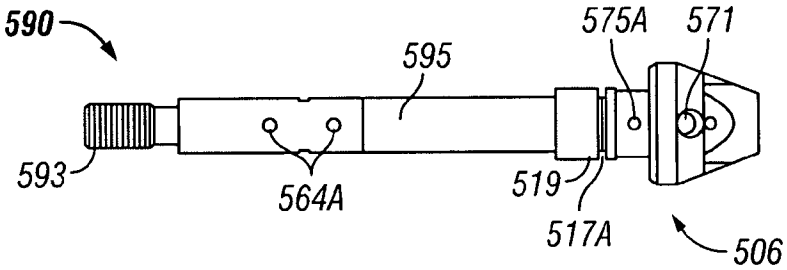
FIGS. 5A, 5B, and 5C show various views of an inner mandrel used in a multifunctional cleaning tool, in accordance with embodiments of the present disclosure.
Figure 5A:
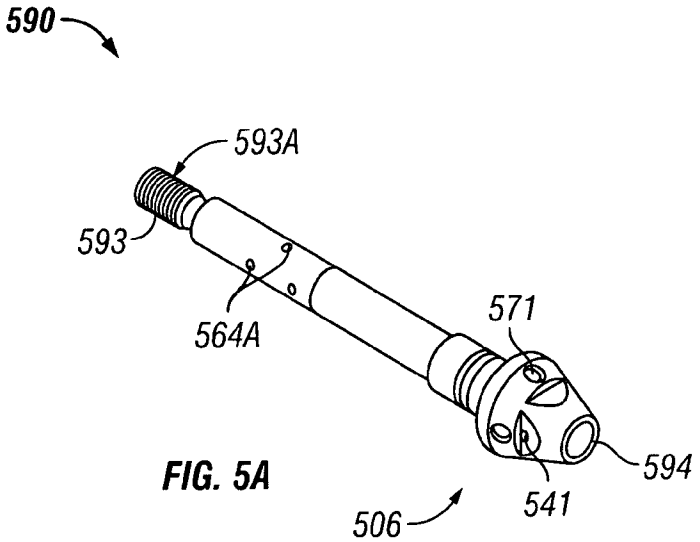
Figure 5C:
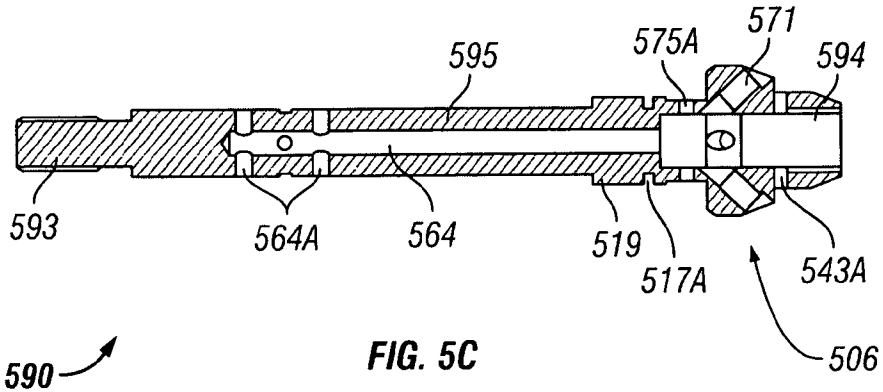

Referring now to FIG. 4, a cross-sectional view of a multifunctional cleaning tool 400 with a coupler 418 according to embodiments of the present disclosure, is shown. Like the tools 200 and 300 previously described, a multifunctional cleaning tool ("tool") 400 may be used to clean tubular members, such as pipelines, wellbores, etc., as well as other operations associated therewith. As such, the tool 400 may include similar components and materials of construction as described for tools 200 and 300.

The tool 400 may be multifunctional in the sense that tool 400 may be used for operations beyond that of just cleaning. For example, the tool 400 may also be used to support the deployment of additional tools connected thereto into the pipeline (231, FIG. 2A). Accordingly, there may be a coupler 418 disposed on either end of the tool 400, whereby the coupler 418 may be configured for connecting other devices to the cleaning tool 400. In some embodiments, there may be a coupler 418 disposed on the first end 408, while in other embodiments the coupler 418 may be disposed on the first end, the second end, or both (not shown).

The coupler 418 may be configured for a specific purpose, such as to provide the tool 400 with the ability to be fished. As such, the coupler 418 may be configured with a fishing neck (319, FIG. 3A). The coupler 418 may be configured as a knuckle joint at least partially disposed and/or engaged between an end cap 488 and an end 488A of tool body 403. There may be a bracing member 449 engaged with the coupler 418, which may provide support to devices that extend outward from the coupler 418. As illustrated, the bracing member 449 may be internal to the coupler 418; however, the bracing member 449 may just as well be external to the coupler 418.

The tool 400 may be connected to, and deployed at the end of a tethered line 466, such as wireline, which may allow the tool 400 to be extended into the pipeline via surface equipment or the like. There are a number of kinds tethered lines available for use with tool 400, which may include (without limitation) hollow line (e.g., capillarity tubing), braided line, slick line, e-line, etc. In an embodiment, braided line may be used because braided line may provide the best protection against inadvertent tearing or rupturing of the tethered line 466.

The tethered line 466 may be connected to the tool via insertion into tether tube 448, and may also provide an operative connection for electrical circuitry, data transmission, etc. between the tool 400 and surface equipment. In order to connect the tethered line, strands 466A of the line 466 may be unwrapped and inserted into the tube 488, and subsequently wrapped around spool 448A. The tethered line 466 connected to the spool 448A may be configured to break or disconnect at a predetermined amount of pulling force. The tethered line 466 may be configured to break at about 70% of its own pull strength.

This means, for example, that the tethered line 446 may have a maximum strength or shear/cut point of 100%, but that the tethered line 446 coupled to the connector may be configured to shear/cut at 70% of the maximum strength. In an embodiment, 70% of the strands are wrapped around the spool 448A, while 30% of the strands are left unwrapped and/or are cut. In an exemplary embodiment, the third predetermined pressure or pressure range may be less than or equal to about the proportional equivalent of the predetermined amount of pulling force. As such, the tool 400 may be configured for the bypass system to actuate (e.g., shear screws 317 shear) before the tethered line 446 breaks.

As previously mentioned, the tool 400 may be configured for the connection of other tools and devices attached thereto. As an example, and as illustrated in FIG. 4A, there may be a spear device 453 coupled to the PRA 406. Although not shown, at least a portion of the PRA 406 may be removed from the tool 400, such that the tool 400 may be adapted for the spear 453 to couple directly to the second end 409 of the tool 400.

Coupling the tool 400 with spear 453 may provide the tool 400 with the ability to retrieve other downhole tools, such as a stuck pig (not shown). Spear member 477 may have internal bore (not shown), and spear 453 may have a head member 452 with sharpened tip 452A. In an embodiment, the spear member 477 may have external threads 477A, which may securely engage the spear 453 with a corresponding threaded surface 498 of the hollow 494. In operation, the tool 400 may be supplied with sufficient enough propulsion in order for the tool 400 and the spear 453 to adequately stab or spear a stuck tool, such as a pig. Although illustrated as a spear, the use of additional tools with tool 400 is not limited by depicted embodiments, and tool 400 may accordingly be configured to operate with an unlimited number of other tools, such as a frac plug, perforating gun, completion tools, etc., as would be known to one of skill in the art.

Figure 6A:
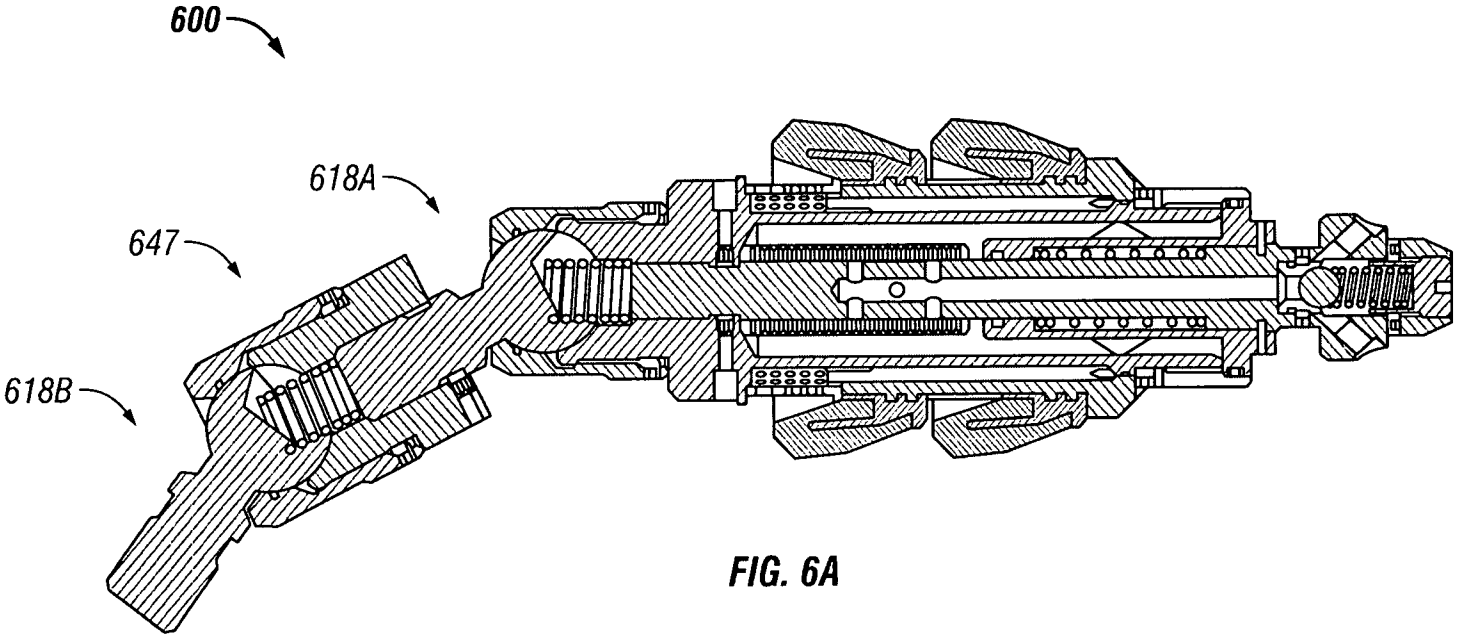
FIGS. 6A, 6B, and 6C show various views of a communication and monitoring system used with a multifunctional cleaning tool, in accordance with embodiments of the present disclosure.
Figure 6B:
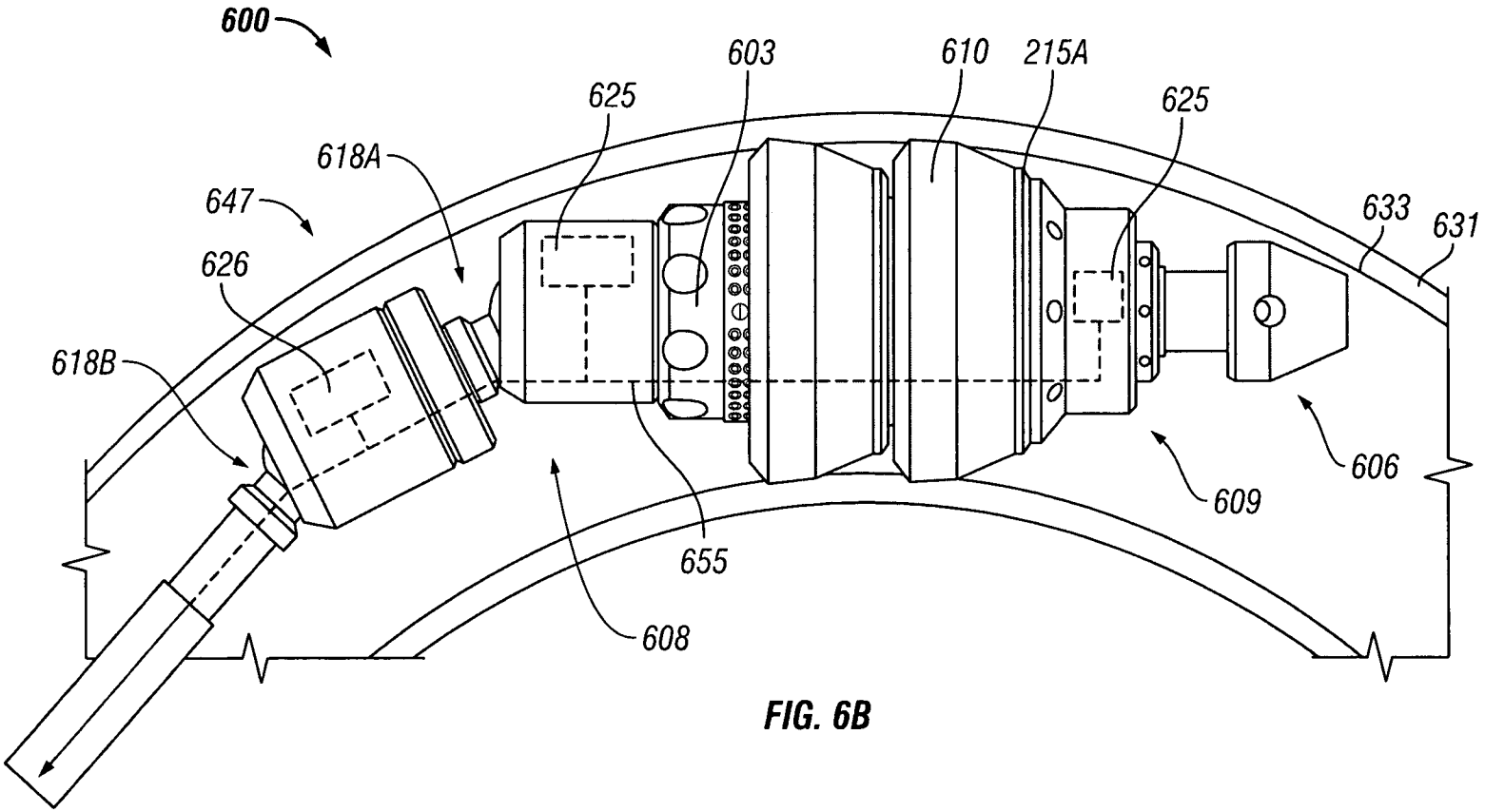
Figure 6C:
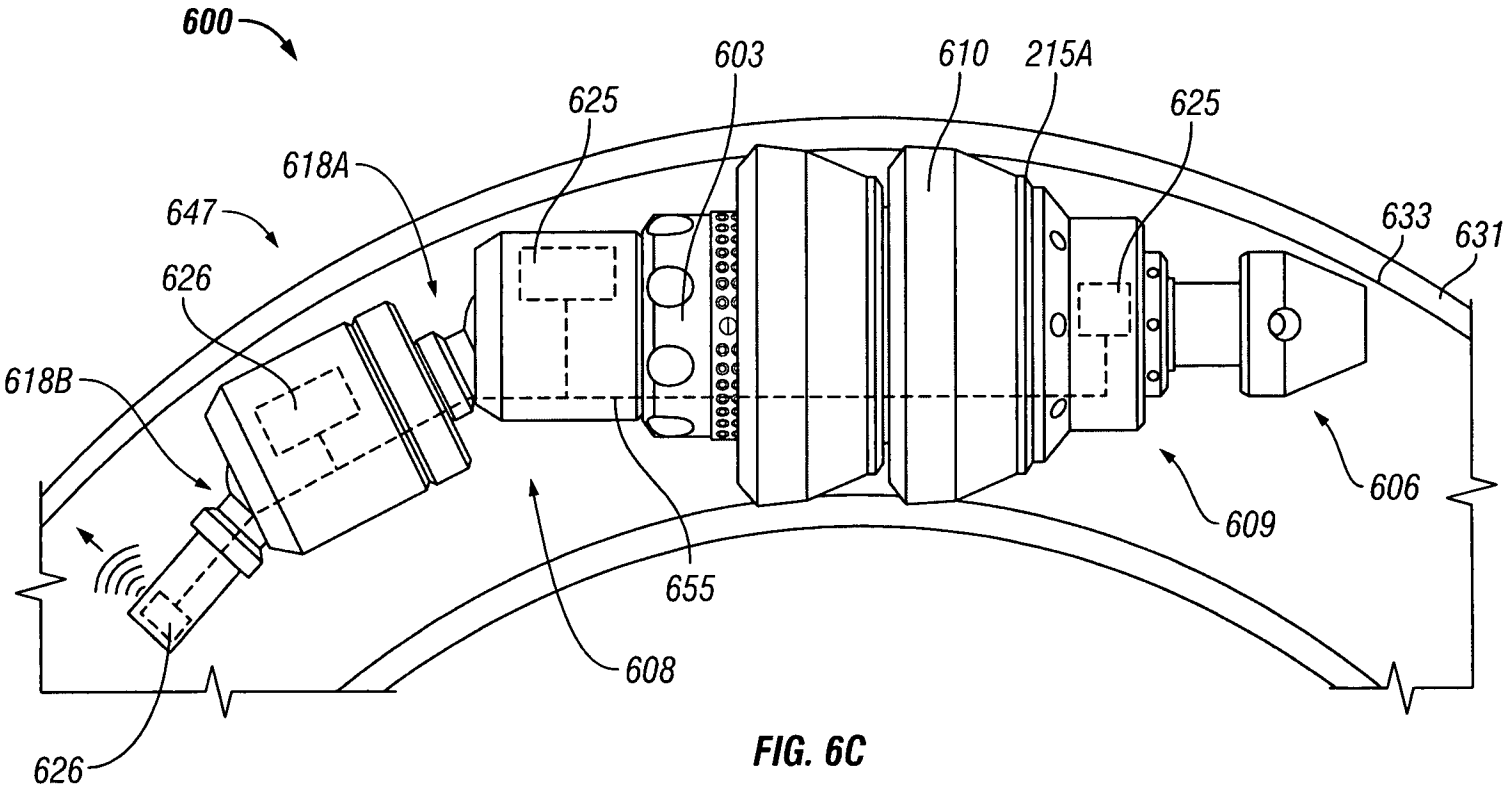

Referring now to FIGS. 6A, 6B, and 6C, communication and monitoring devices used with a multifunctional cleaning tool 600 according to embodiments of the present disclosure, are shown. Like the tools 200, 300, and/or 400 previously described, a multifunctional cleaning tool ("tool") 600 may be used to clean tubular members, such as pipelines, wellbores, etc., as well as other operations associated therewith. As such, the tool 600 may include similar components and materials of construction as previously described for any other tools.

FIGS. 6A-6C together illustrate the tool 600 may be multifunctional in the sense that tool 600 may be used for operations beyond that of just cleaning. In some embodiments, the tool 600 may be configured with one or more measurement devices 625, such that the tool 400 may have "smart tool" capabilities. In other embodiments, there may be at least one communication device 626 operatively connected with the tool 600, which may be used to provide communication capability between the tool 600 and a monitoring system (not shown).

The tool 600 may include the use of a sub 647, which may be connected to the tool 600 by a first coupler 618A. The sub 647 may also be connected with a second coupler 618B that extends out in an opposite direction of the first sub 618A. As such, the coupler 618B, and hence the tool 600, may be connected with a tethered line (446, FIG. 4), as previously described. The use of multiple couplers may provide the tool 600 with an extra bendable moment that makes it easier for the tool 600 to run through pipelines that have bends, angles, or other tortuous surfaces.

The measurement devices 625 or other sensor(s) may, for example, be electrically connected and operated, as would be known to one of skill in the art. When the measurement device(s) 625 detects or measures a parameter or other datum, the device 625 via communication linkage or other circuitry 655 sends the applicable signal to the monitoring system, which may be located at a surface facility.

The use of measurement devices and sensors may provide tool 600 with the ability to communicate operators, users, automated controllers, etc. Although circuitry 655 is not illustrated as connected to each and every part of the tool 600, it would be obvious to one of ordinary skill in the art that any and all components that require an operative connection may be connected with circuitry 655. The type of circuitry used is not meant to be limited, and may include other comparable circuitry known to one of ordinary skill in the art, such as electrical, fiber optic cable, infrared, wireless, etc.

As such, all job site data may be logged in an on-site monitoring console (not shown), which may operate and/or monitor any and all parameters of a particular job. The monitoring console may beneficially monitor and control loads, depth, pump pressure, running speeds, and any other operational variable.

Embodiments disclosed herein may include methods of cleaning a tubular with a multi-functional cleaning tool that includes the steps of disposing the cleaning tool in the tubular, the cleaning tool having a main body with a first end, a second end, an inlet, an outlet, and a propulsion relief assembly disposed proximate to the second end. The method further includes the steps of sufficiently pressurizing fluid behind the tubular to propel the cleaning tool along the tubular, and increasing the pressure of the fluid to actuate the propulsion relief assembly, whereby fluid is jetted out the outlet and out of the propulsion relief assembly.

Other steps of the method may include connecting a tether line to the cleaning tool, and retrieving the cleaning tool out of the tubular by pulling the tether line. In addition, the method may include bypassing fluid through the second end of the cleaning tool while retrieving the cleaning tool.

The method may include retrieving the cleaning tool out of the tubular, and bypassing pressurized fluid from behind the cleaning tool out through the second end of the cleaning tool while retrieving. In addition, there may be a step of closing off a bypass opening associated with the second end, pressurizing fluid ahead of the cleaning tool, and increasing the pressure of the fluid ahead of the cleaning tool to aid retrieving.

Embodiments disclosed herein may advantageously provide for a multifunctional cleaning tool effectively configured for use in long horizontal pipelines, including the ability to withstand extreme pressures associated with such use. The multifunctional tool may be cost-effectively deployed without the need of continuous tubing and/or tether free. As a result, the multifunctional tool may beneficially avoid the pitfalls associated with continuous tubing used in horizontal pipelines.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A multifunctional cleaning tool for cleaning tubular, the cleaning tool comprising:

a main body comprising a first end and a second end, an inlet proximate to the first end, and one or more first outlets disposed in the second end;

a propulsion relief assembly proximate to the second end, the propulsion relief assembly comprising:

a flow bore fluidly connected to the inlet, wherein the flow bore has a first flow bore end proximate to the inlet and a second flow bore end proximate the second end of the main body;

one or more second outlets disposed in the second end of the main body, and a restrictor disposed at the second flow bore end, wherein the restrictor has an actuation pressure, and the restrictor is configured to prevent flow out of the one or more second outlets at fluid pressures below the actuation pressure; and wherein:

at a first fluid pressure, below the actuation pressure, the cleaning tool is configured to move the tool through the tubular, and provide flow out the one or more first outlets, while the restrictor prevents flow out of the one or more second outlets, and at a second fluid pressure, above the actuation pressure, the cleaning tool is configured to provide flow out of the one or more first outlets and the one or more second outlets.

2. The multifunctional cleaning tool of claim 1 further comprising:

a first sleeve sealingly engaged to the main body; and a first seal cup connected to the first sleeve.

3. The multifunctional cleaning tool of claim 1 further comprising a coupler movingly engaged with the first end, wherein the coupler is configured for connecting other devices to the cleaning tool.

4. The multifunctional cleaning tool of claim 3, wherein the coupler comprises a finishing neck.

5. The multifunctional cleaning tool of claim 1, wherein a third fluid pressure removably detaches a piston from the second end forming a bypass flow passage out of the second end.

6. The multifunctional cleaning tool of claim 1, wherein the cleaning tool is deployed with a tether line.

7. The multifunctional cleaning tool of claim 6, wherein the connection of the tether line with the cleaning tool has a first pre-determined break point, wherein a movable piston frangibly connected with the tool has a second pre-determined break point, and wherein the first pre-determined break point is greater than the second pre-determined break point.

8. The multifunctional cleaning tool of claim 1, further comprising an internal mandrel connected to the main body, wherein the flow bore extends through the internal mandrel, and the internal mandrel comprises one or more channels fluidly coupling the inlet to the flow bore.

9. The multifunctional cleaning tool of claim 1, wherein the restrictor is a ball positioned in a ball seat.

10. The multifunctional cleaning tool of claim 1, further comprising an energizer disposed against the restrictor, the energizer being adjustable to control the actuation pressure of the restrictor.

* * * * *

UNITED STATES PATENT AND TRADEMARK OFFICE

CERTIFICATE OF CORRECTION

PATENT NO. : 8,707,498 B2
APPLICATION NO. : 12/925637
DATED : April 29, 2014
INVENTOR(S) : James B. Crawford et al.

It is certified that error appears in the above-identified patent and that said Letters Patent is hereby corrected as shown below:

Title page

Item (75), line 2 "Elsbury," should be -- Elsbury III, --.

Signed and Sealed this
Twentieth Day of October, 2015

Michelle K. Lee

Michelle K. Lee
*Director of the United States Patent and Trademark Office*